US010774805B2

(12) United States Patent
Mixell et al.

(10) Patent No.: US 10,774,805 B2
(45) Date of Patent: Sep. 15, 2020

(54) IGNITER ASSEMBLY WITH IMPROVED INSULATION AND METHOD OF INSULATING THE IGNITER ASSEMBLY

(71) Applicant: TENNECO INC., Lake Forest, IL (US)

(72) Inventors: Kristapher I. Mixell, Plymouth, MI (US); Yusuf Esmail Neemuchwala, Livonia, MI (US); John E. Miller, Temperance, MI (US); James D. Lykowski, Temperance, MI (US); John Antony Burrows, Altrincham (GB)

(73) Assignee: Tenneco Inc., Lake Forest, IL (US)

( * ) Notice: Subject to any disclaimer, the term of this patent is extended or adjusted under 35 U.S.C. 154(b) by 60 days.

(21) Appl. No.: 16/526,046

(22) Filed: Jul. 30, 2019

(65) Prior Publication Data

US 2019/0353136 A1 Nov. 21, 2019

Related U.S. Application Data

(62) Division of application No. 15/935,540, filed on Mar. 26, 2018, now Pat. No. 10,364,788.

(Continued)

(51) Int. Cl.

| | |
|---|---|
| ***F23Q 3/00*** | (2006.01) |
| ***F02P 23/04*** | (2006.01) |
| ***H01T 13/50*** | (2006.01) |
| ***H01F 27/32*** | (2006.01) |
| ***H01T 13/44*** | (2006.01) |
| ***H01T 21/02*** | (2006.01) |

(Continued)

(52) U.S. Cl.

CPC ..... *F02P 23/04* (2013.01); *H01F 27/321* (2013.01); *H01T 13/44* (2013.01); *H01T 13/50* (2013.01); *H01T 21/02* (2013.01); *F02P 3/01* (2013.01); *H01F 27/306* (2013.01); *H01F 38/12* (2013.01); *H01T 13/56* (2013.01); *H01T 19/02* (2013.01)

(58) Field of Classification Search

CPC ..... F02M 57/00; F02M 57/06; F02P 13/00

USPC ..... 123/297, 151, 152, 169 V, 169 R, 143 R, 123/146, 146.5; 361/247

See application file for complete search history.

(56) References Cited

U.S. PATENT DOCUMENTS 6,166,452 A * 12/2000 Adams ..... F42B 3/121 307/10.1

7,923,662 B2 * 4/2011 Hale ..... F23Q 3/006 219/270

(Continued)

*Primary Examiner* — John Kwon

(74) *Attorney, Agent, or Firm* — Robert L. Stearns; Dickinson Wright, PLLC

(57) ABSTRACT

An igniter assembly comprising an ignition coil assembly connected to a firing end assembly by an extension, with a valve assembly disposed in a pressure chamber of the extension, is provided. The valve assembly includes a valve stem biased toward the ignition coil assembly by a spring to seal the pressure chamber. The valve assembly is used to evacuate contents from the pressure chamber by pressing the valve stem toward the spring and allowing contents of the pressure chamber to travel through and past the valve stem and out of the pressure chamber. The valve assembly is also used to fill the pressure chamber with an insulating medium by pressing the valve stem toward the spring and allowing the insulating medium to travel through and past the valve stem and into the pressure chamber after evacuating the contents out of the pressure chamber.

3 Claims, 10 Drawing Sheets

Related U.S. Application Data

(60) Provisional application No. 62/477,299, filed on Mar. 27, 2017.

(51) Int. Cl.

| | |
|---|---|
| *H01F 38/12* | (2006.01) |
| *H01T 19/02* | (2006.01) |
| *H01F 27/30* | (2006.01) |
| *H01T 13/56* | (2006.01) |
| *F02P 3/01* | (2006.01) |

(56) References Cited

U.S. PATENT DOCUMENTS

| | | | | |
|---|---|---|---|---|
| 8,547,680 | B2 * | 10/2013 | Koike | F42B 3/18 102/200 |
| 8,653,693 | B2 * | 2/2014 | Aulisio | F02K 9/95 123/603 |
| 2005/0225925 | A1 * | 10/2005 | Sibrai | B60R 21/0173 361/247 |

* cited by examiner

IGNITER ASSEMBLY WITH IMPROVED INSULATION AND METHOD OF INSULATING THE IGNITER ASSEMBLY

CROSS REFERENCE TO RELATED APPLICATIONS

This U.S. Divisional application claims priority to U.S. Utility patent application Ser. No. 15/935,540, filed Mar. 26, 2018, which claims the benefit of U.S. Provisional Patent Application Ser. No. 62/477,299, filed Mar. 27, 2017, the entire disclosure of the application being considered part of the disclosure of this application, and hereby incorporated by reference.

BACKGROUND

1. Field of the Invention

This invention relates generally to corona ignition assemblies, and methods of manufacturing the corona ignition assemblies.

2. Related Art

Corona discharge ignition systems typically include a corona igniter assembly typically with a firing end assembly and an ignition coil assembly attached to one another and inserted into a combustion chamber of an engine. The firing end assembly includes a central electrode charged to a high radio frequency voltage potential, creating a strong radio frequency electric field in a combustion chamber. The electric field causes a portion of a mixture of fuel and air in the combustion chamber to ionize and begin dielectric breakdown, facilitating combustion of the fuel-air mixture. The electric field is preferably controlled so that the fuel-air mixture maintains dielectric properties and corona discharge occurs, also referred to as non-thermal plasma. The ionized portion of the fuel-air mixture forms a flame front which then becomes self-sustaining and combusts the remaining portion of the fuel-air mixture. The electric field is also preferably controlled so that the fuel-air mixture does not lose all dielectric properties, which would create a thermal plasma and an electric arc between the electrode and grounded cylinder walls, piston, or other portion of the igniter. Ideally, the field is also controlled so that the corona discharge only forms at the firing end and not along other portions of the corona igniter assembly. However, such control is oftentimes difficult to achieve.

For example, a significant amount of energy that should be transferred from the coil of the ignition coil assembly to the igniter of the firing end assembly through an insulating medium can be lost through the insulating medium used to connect the coil and the igniter, referred to as an extension. The energy loss can occur due to capacitive and dissipative losses and loss due to formation of corona in the extension.

SUMMARY

One aspect of the invention provides an igniter assembly, for example a corona igniter assembly. The igniter assembly comprises an ignition coil assembly including a coil, a firing end assembly including an igniter and coupled to the ignition coil assembly by an extension, and the extension contains a pressure chamber. A central conductor is disposed between the ignition coil assembly and the firing end assembly for transferring energy from the coil to the igniter. A valve assembly is disposed in the pressure chamber of the extension for allowing evacuation of contents of the pressure chamber and allowing the pressure chamber to be filled with an insulating medium. The valve assembly seals the insulating medium in the pressure chamber. The valve assembly includes a valve stem, and the valve stem is biased toward the ignition coil assembly by a spring to maintain the sealing of the pressure chamber.

The valve assembly together with the ignition coil assembly, extension and firing end assembly can provide for improved sealing, reduced packaging, and thus lower energy loss in the extension, as well as a compact packaging of the igniter with the coil. The valve assembly can also contribute to improved electrical fields and can mitigate problems that typically occur using an external fill valve.

Another aspect of the invention provides a method of manufacturing an igniter assembly. The method comprises the steps of coupling a central conductor to a firing end assembly including an igniter, coupling the firing end assembly to an extension containing a pressure chamber, and disposing a valve assembly in the pressure chamber of the extension. The valve assembly includes a valve stem, and the valve stem and/or a sealing device located around the valve stem seals the pressure chamber when the valve stem is biased away from the firing end assembly by a spring. The method also includes evacuating contents of the pressure chamber by pressing the valve stem toward the spring and allowing contents of the pressure chamber to travel past the valve stem and out of the pressure chamber, and filling the pressure chamber with an insulating medium by pressing the valve stem toward the spring and allowing the insulating medium to travel past the valve stem and into the pressure chamber after evacuating the contents out of the pressure chamber. The method further includes biasing the valve stem away from the firing end assembly with the spring so that the valve stem maintains a seal of the pressure chamber containing the insulating medium, and coupling an ignition coil assembly including a coil to the central conductor and the extension.

Yet another aspect of the invention provides a method for providing an insulating medium to an igniter assembly. The igniter assembly comprises a firing end assembly including an igniter, and the igniter is coupled to a central conductor and an extension containing a pressure chamber with a valve assembly disposed in the pressure chamber of the extension. The method comprises the steps of pressing a valve stem of the valve assembly into a spring, providing the insulating medium past the valve stem to fill the pressure chamber of the extension with the insulating medium, and sealing the pressure chamber containing the insulating medium with the valve stem and/or a sealing device located around the valve stem.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF EXEMPLARY EMBODIMENTS

Figure 1:
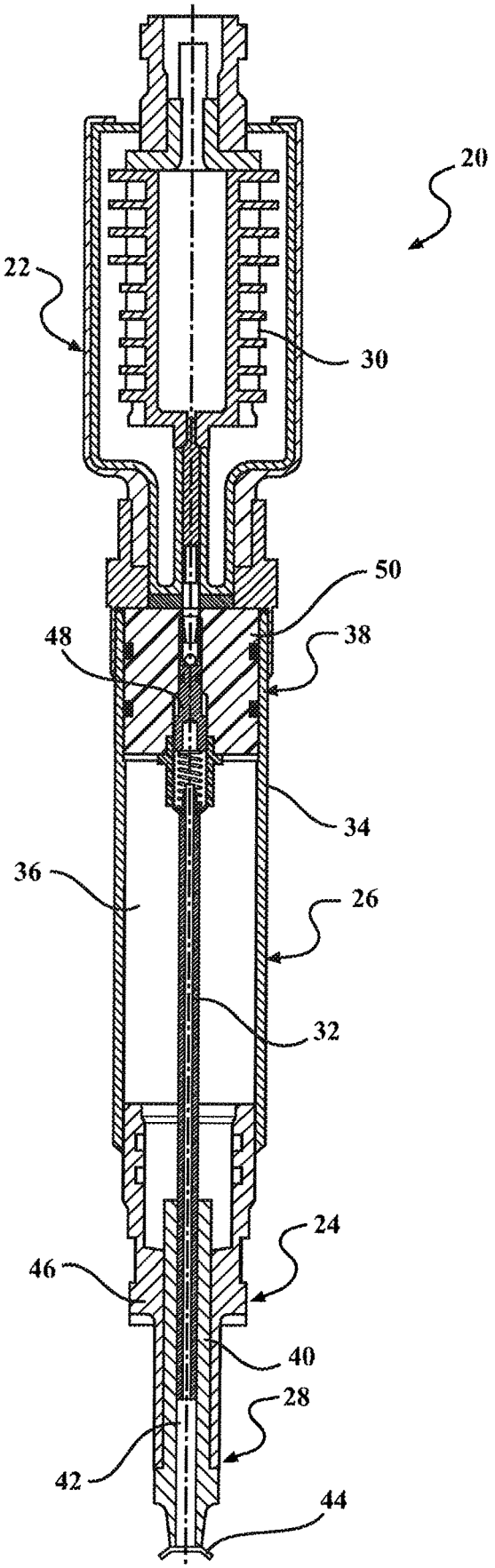
FIG. 1 is a cross-sectional view of a corona igniter assembly including an ignition coil extension, firing end assembly, extension, and valve assembly according to an example embodiment.

One aspect of the invention provides an igniter assembly for an internal combustion engine, such as a corona igniter assembly 20 as shown in FIG. 1. The corona igniter assembly 20 includes an ignition coil assembly 22 producing a high radio frequency and high voltage electrical field, and a firing end assembly 24 distributing the electrical field in the combustion chamber for fuel ignition. An extension 26 connects the ignition coil assembly 22 to the firing end assembly 24. The firing end assembly 24 includes a corona igniter 28, the ignition coil assembly 22 includes a coil 30, and energy is transferred from the coil 30 to the corona igniter 28 through a central conductor 32. In the example embodiment, the central conductor 32 is formed of brass. The extension 26 includes a tube 34 containing a sealed pressure chamber 36 which surrounds the central conductor 32. The tube 34 could be rigid or flexible made of any impermeable material. In the example embodiment, the tube 34 is formed of steel.

A valve assembly 38 is connected to the central conductor 32 and the tube 34 for evacuating contents of the sealed pressure chamber of the tube 34, and then filling the sealed pressure chamber 36 of the tube 34 with an insulating medium, such as pressurized gas. The ignition coil assembly 22 is also typically connected to the valve assembly 38 after the sealed pressure chamber 36 is filled with the insulating medium. Although the valve assembly 38 is described in connection with the corona igniter assembly 20, it is noted that the valve assembly 38 could be used with other types of igniter assemblies.

In the example embodiment shown in FIG. 1, the firing end assembly 24 includes an insulator 40, typically formed of ceramic, disposed around a bottom portion of the central conductor 32 and around a central electrode 42 of the corona igniter 28. The central electrode 42 is coupled to the central conductor 32 for receiving energy from the coil 30. In the example embodiment, the corona igniter 28 includes a firing tip 44 including a plurality of prongs at a firing end of the central electrode 42. The firing end assembly 24 of this embodiment also includes a metal shell 46 surrounding the insulator 40 and connected to the tube 24 of the extension 26. The ignition coil assembly 22 and the firing end assembly 24 shown in FIG. 1 are only example embodiments, and the ignition coil assembly 22 and the firing end assembly 24 can have various other designs and include various other components.

The valve assembly 38 is shown in the Figures and includes a valve stem 48 surrounded by a valve housing 50. The valve housing 50 can be formed of a single piece, or more than one piece. The valve housing 50 can also include an inner portion, referred to as a valve body, which is sealed to an outer portion of the valve housing 50. The valve housing 50 is disposed in the sealed pressure chamber 36 of the extension 26 adjacent an upper end of the extension 26 and is also connected to the ignition coil assembly 22.

Figure 2:
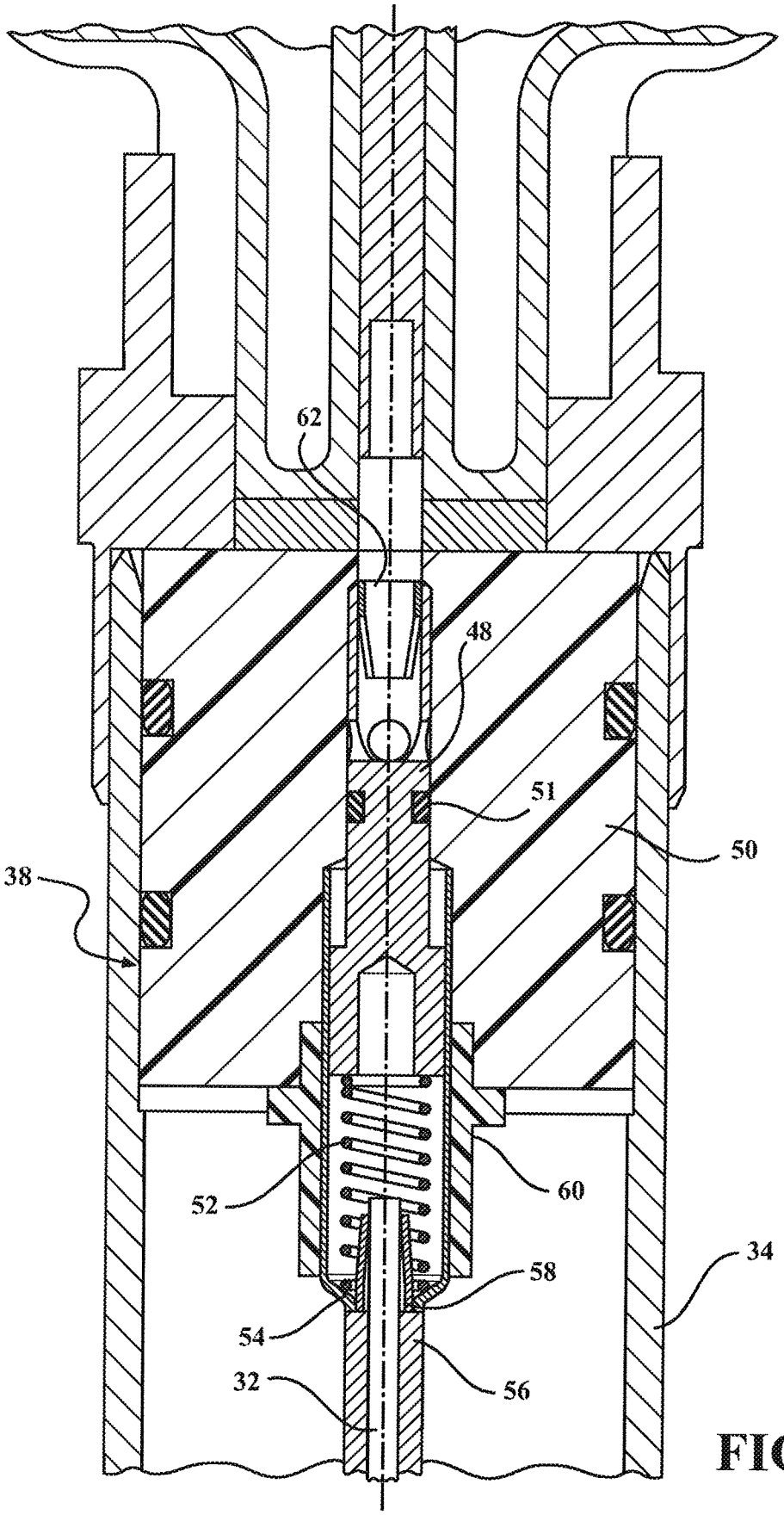
FIG. 2 is an enlarged view of the valve assembly of the example embodiment.

FIG. 2 is an enlarged view of the valve assembly 38 according to the example embodiment. The valve assembly 28 of this embodiment includes the valve housing 50 which is typically formed of a plastic or other insulating material. The valve stem 48 is typically formed of metal, such as brass, or other highly conductive material, and is disposed in a bore of the valve housing 50. A conductive coating can be applied along the bore of the valve housing 50 to further reduce electric field. In the example embodiment, an O-ring 51, in this case a male static O-ring seal, is disposed around the valve stem 48 to seal the valve stem 48 against the valve housing 50. One or more additional O-rings are also disposed around the valve housing 50 to seal the valve housing 50 against the tube 34.

A lower end of the valve stem 48 is connected to a spring 52 formed of metal. The spring 52 can be a coil spring, as shown in the drawings, or another type of spring. Although the spring 52 is coupled to the central conductor 32, the spring 52 is not directly connected to the central conductor 32, but rather is electrically connected to the central conductor 32 through a spring seat 54 on which it rests, which is explained further below. In the example embodiment, the spring seat 54 is located adjacent an upper end of a sleeve 56 which surrounds the central conductor 32. The sleeve 56 is typically made of conductive silicon, PTFE, or any other low dielectric insulating material. The spring seat 54 is preferably conductive. The spring seat 54 extends upward from the sleeve 56 and surrounds the spring 52. The spring seat 54 is preferably conductive and helps mitigate corona formation in a cavity formed between the spring 52 and the valve housing 50.

A lower connector 58, referred to as a slip connector, is disposed along the spring seat 54 between the spring 52 and the sleeve 56. The central conductor 32 is attached to the lower portion of the spring seat 54 by the lower connector 58. In the example embodiment, a spring seat cover 60 formed of plastic or other insulating material is disposed around the spring 52. A top end of the spring seat cover 60 is received in the bore of the valve housing 50, and a bottom end of the spring seat cover 60 is located near the base of the spring seat 54. In an another example embodiment, the bore of the valve housing 50 could have a conductive plating to further reduce corona formation losses and failure paths initiating in a cavity formed between the spring 52 and the valve housing 50. The spring seat 54 could then be made of an insulating material with a conductive bore and will help eliminate the spring seat cover 60. In the example embodiment of the Figures, an upper connector 62 connects the valve stem 48 to the ignition coil assembly 22.

In the example embodiment, the valve stem 48 is free to move axially only, concentrically sliding against the bore in the valve housing 50. The spring 52 helps to hold or bias the valve stem 48 in its closed position, which is away from the igniter assembly 20 and toward the ignition coil assembly 22. The spring 52 is supported by the spring seat 54 which is press fitted and bonded to the valve housing 50. As discussed above, the valve assembly 38 sits in the sealed pressure chamber 36 of the tube 34. The extension 26, with the valve assembly 38 attached, is attached to the firing end assembly 24. More specifically, a lower end of the tube 34 is attached to the metal shell 46 of the corona igniter 28 with the help of a weld and O-rings 51 to seal the sealed pressure chamber 36.

Figure 3B:
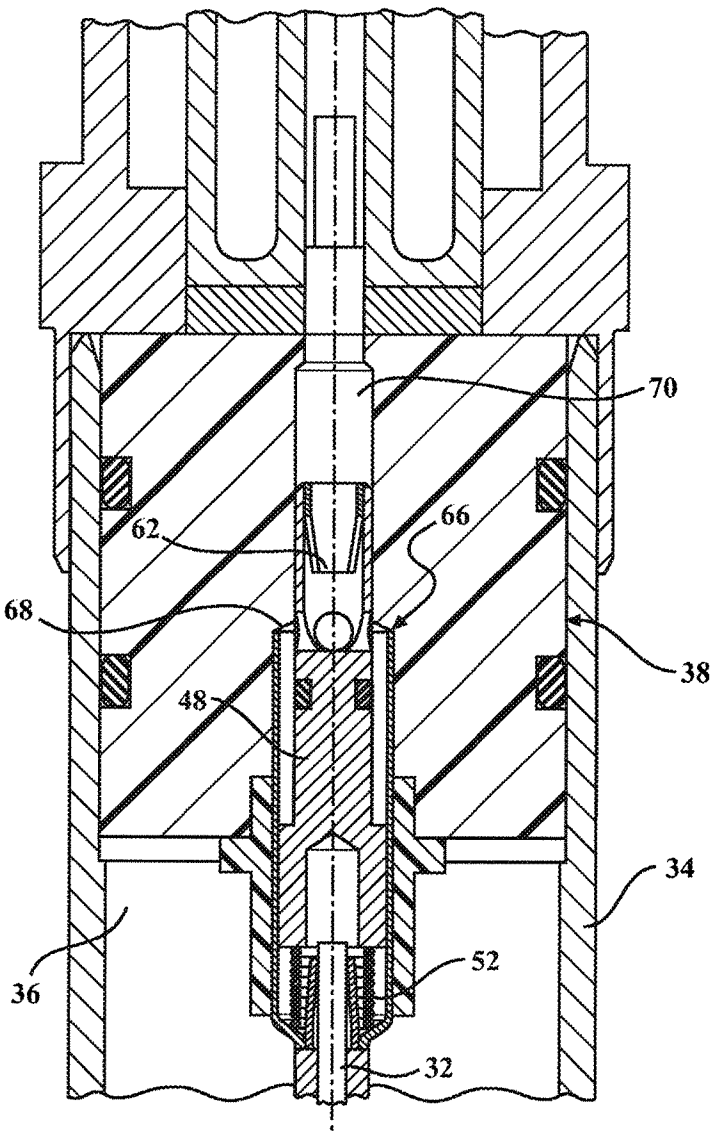
FIG. 3B is an enlarged view of the valve assembly of FIG. 3A in an open configuration.
Figure 3A:
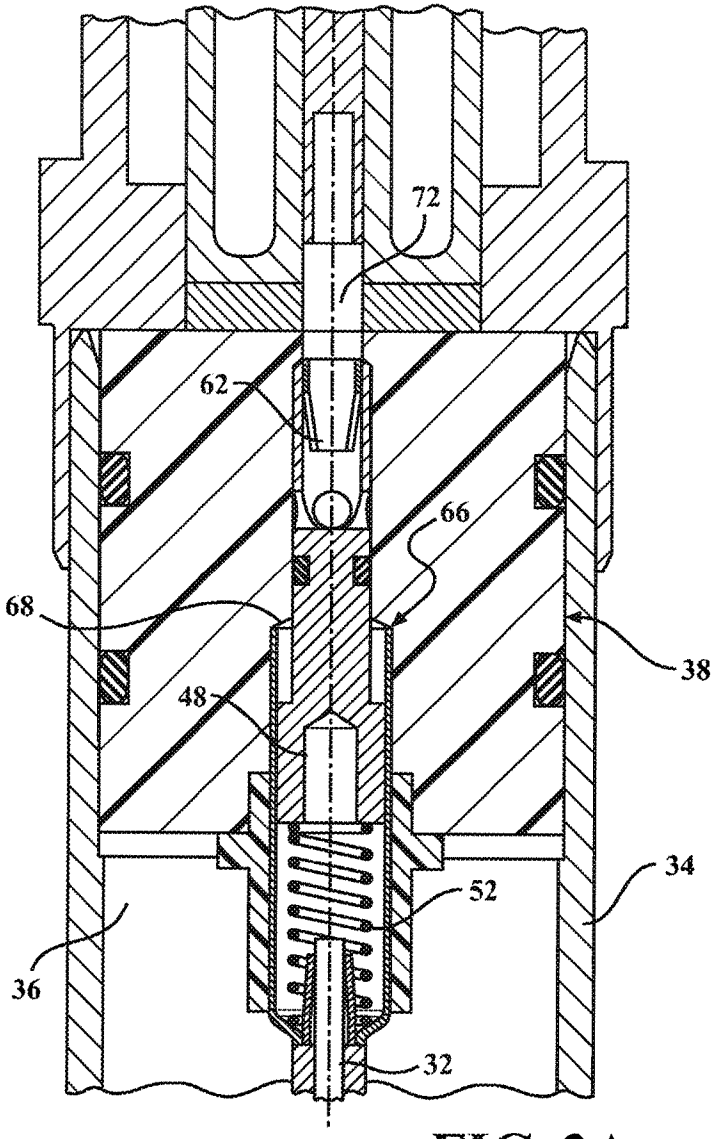
FIG. 3A is an enlarged view of the valve assembly of the example embodiment in a closed configuration.
Figure 10D:
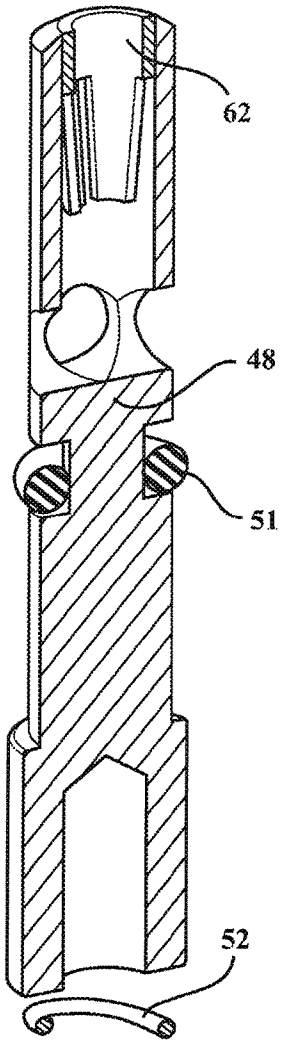
FIG. 10D is another cross-section of the valve stem and the upper connector.
Figure 10C:
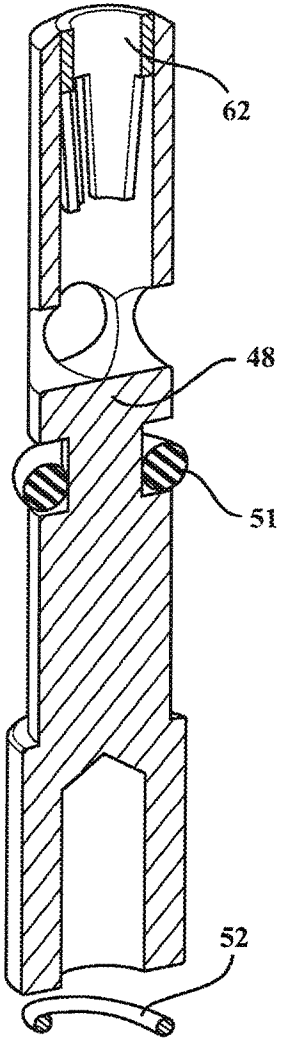
FIG. 10C is a cross-section of the valve stem and the upper connector and illustrates gas flow through the valve stem when vacuuming the pressure chamber.
Figure 10B:
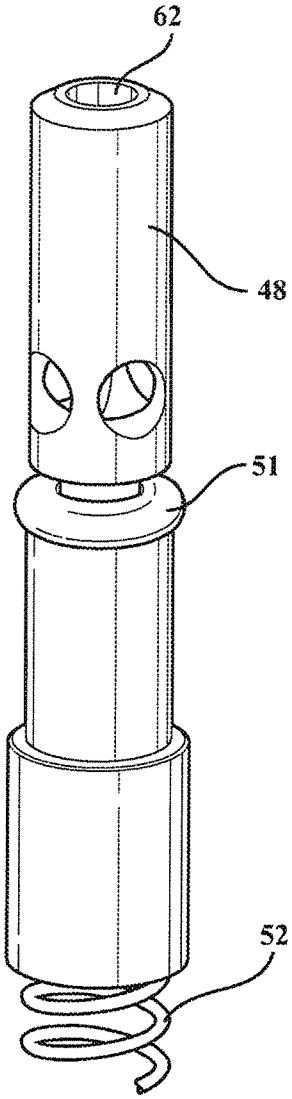
FIG. 10B shows the valve stem and the upper connector and illustrates gas flow through the valve stem when pressurizing a pressure chamber of the extension.
Figure 10A:
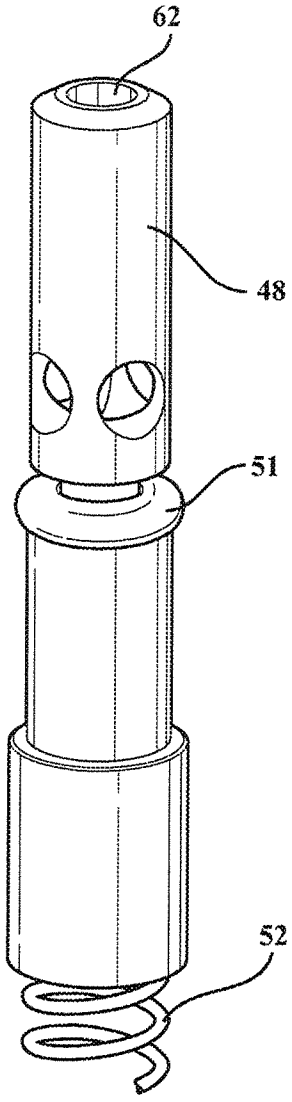
FIG. 10A illustrates a valve stem of the valve assembly and an upper connector according to an example embodiment.

The valve stem 48 according to an example embodiment is shown in FIGS. 10A-10D. The valve stem 48 has an axial hole 67 in which the upper connector 62 is fitted. Two holes 66, orthogonally offset, are cross-drilled perpendicular to the axis of the valve stem 48 in a manner such that they intersect with the axial hole 67 of the valve stem 48. In this embodiment, the O-ring 51 on the valve stem 48 seals against the valve housing 50 and is located below the cross drilled holes 66. Once the valve stem 48 is assembled in the valve housing 50, and when put in the open configuration (FIG. 3B), these three holes 66, 67 together create a passage way for gas to flow from the top of the valve assembly 38 into the pressure chamber 36 or for gas from the pressure chamber 36 to flow out through the valve assembly 38. The passageway is sealed off to the pressure chamber 36 by the O-ring 51 in the closed position (FIG. 3A). FIG. 10A illustrates the valve stem 48 with the holes 66, 67 and the upper connector 62. FIG. 10B shows the valve stem 48 and the upper connector 62 and illustrates the gas flow through the valve stem 48 when pressurizing the pressure chamber 36. FIG. 10C is a cross-section of the valve stem 48 and the upper connector 62 and illustrates the gas flow through the valve stem 48 when vacuuming the pressure chamber 36. FIG. 10D is another cross-section of the valve stem 48 and upper connector 62.

Figure 4B:
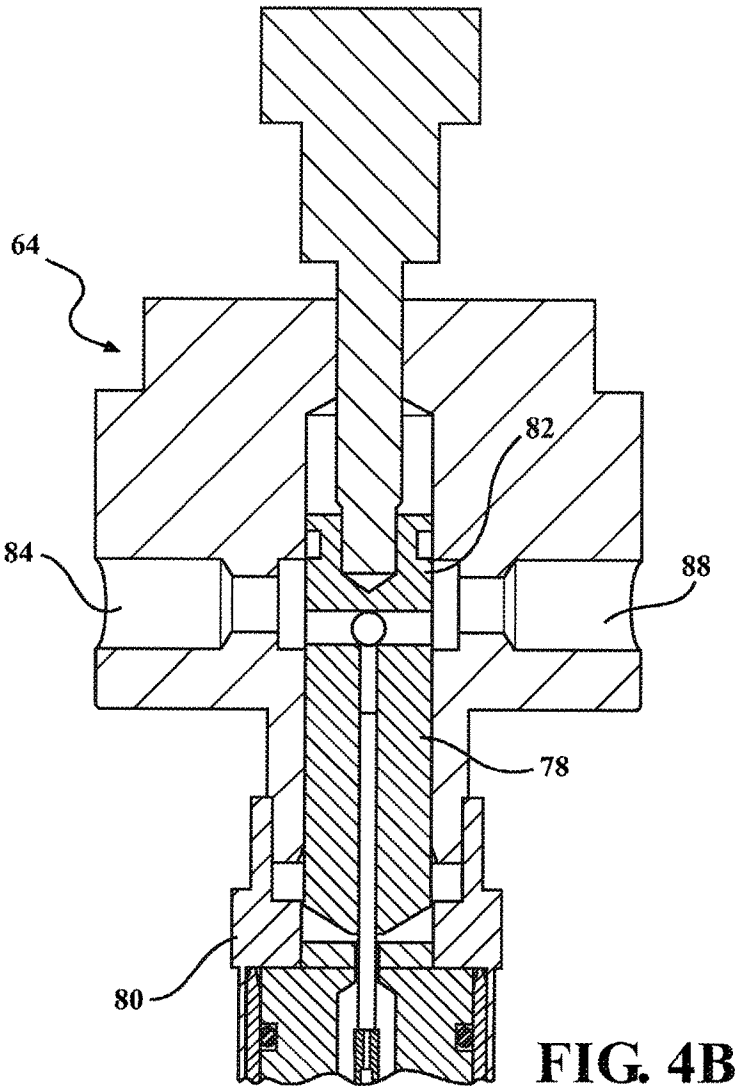
FIG. 4B illustrates the vacuum and pressurizing assembly fixture of FIG. 4A in an open configuration.
Figure 4A:
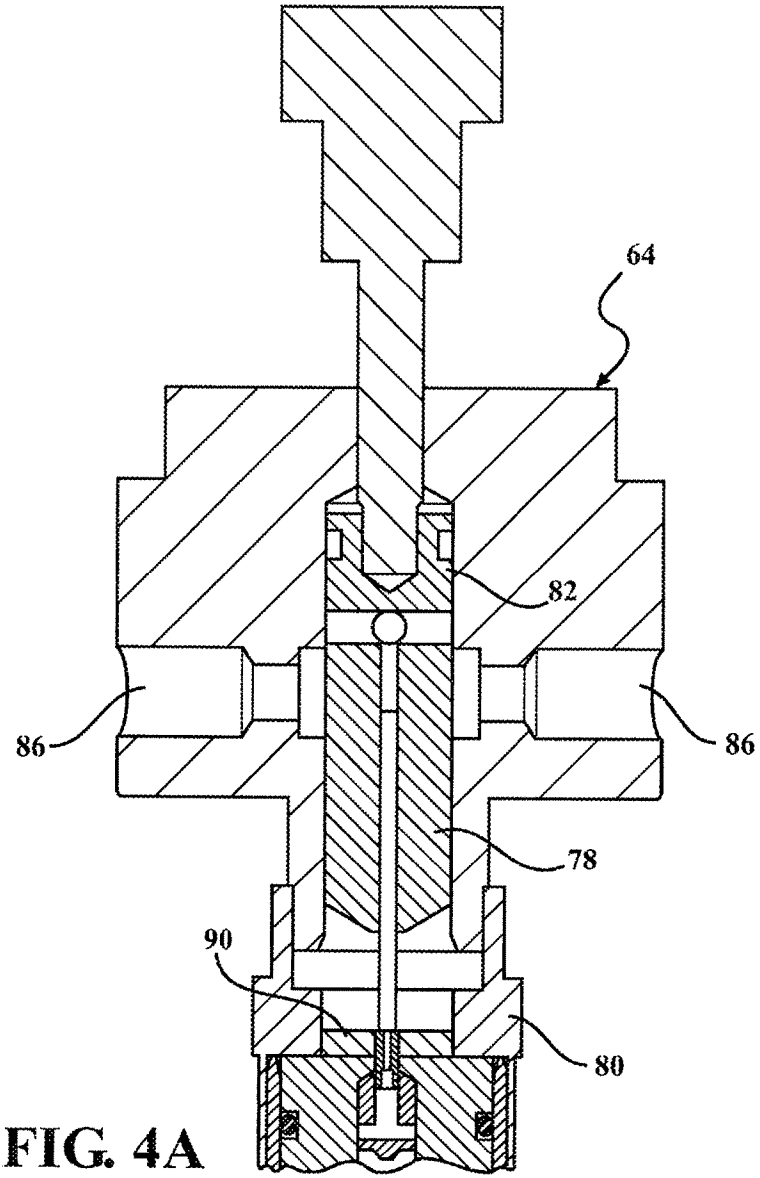
FIG. 4A illustrates a vacuum and pressurizing assembly fixture connected to the valve assembly according to an example embodiment in a closed configuration.
Figure 5B:
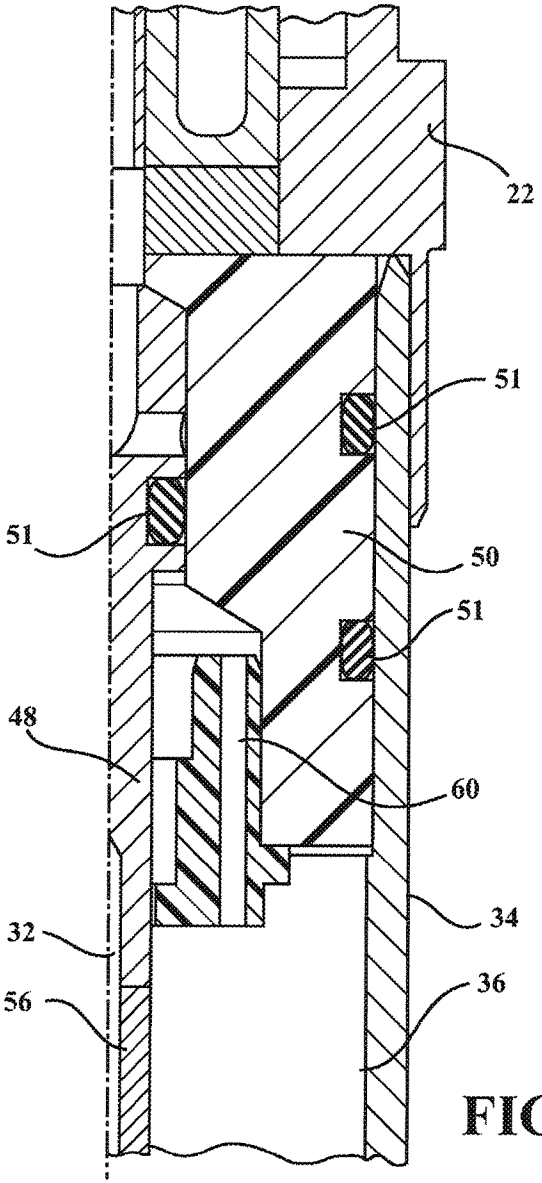
FIGS. 5A and 5B are partial view of the assembly according to an example embodiment.
Figure 5A:
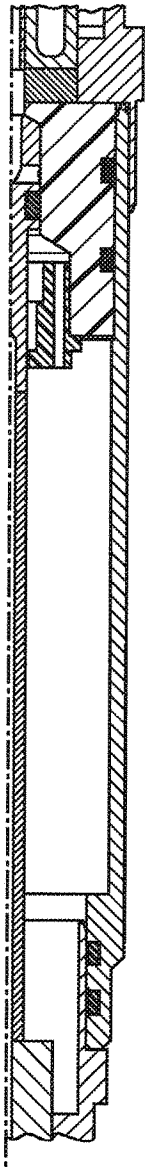
Figure 6A:
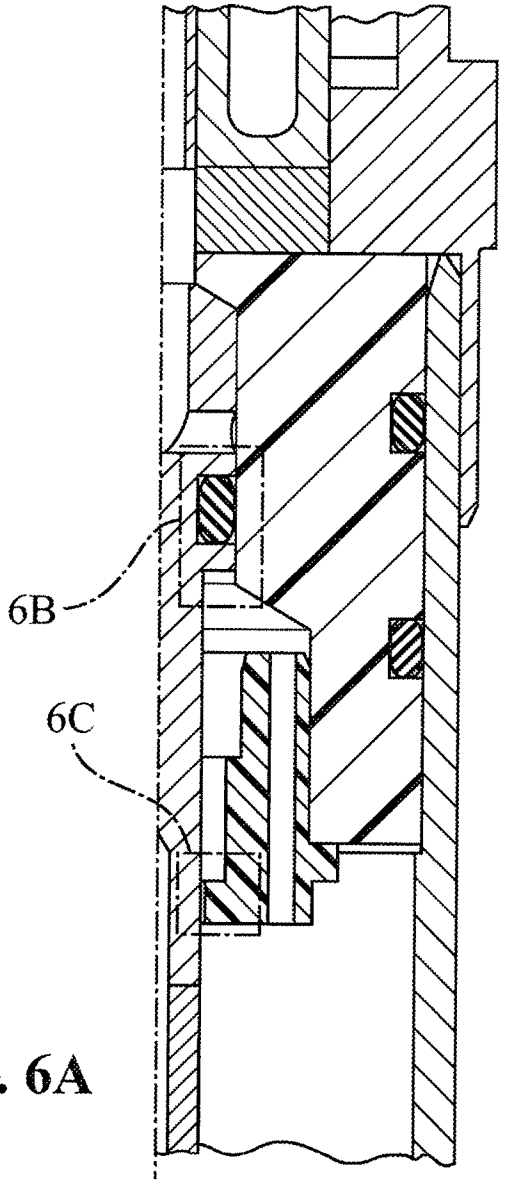
FIG. 6A is a partial view of the assembly according to an example embodiment.
Figure 6B:
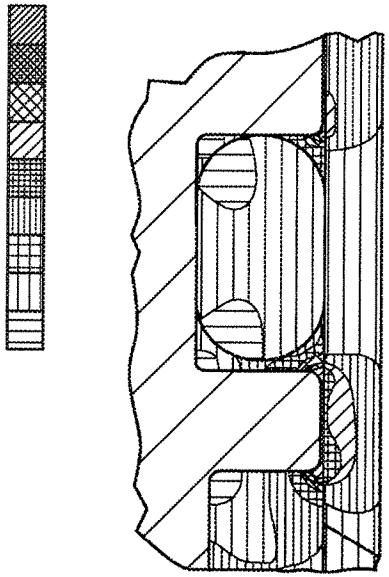
FIGS. 6B and 6C are FEA models showing the electrical field in portions of the assembly of FIG. 6A.
Figure 6C:
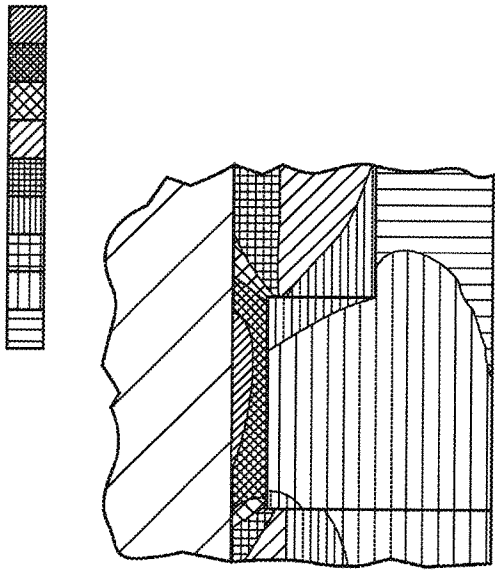
Figure 7A:
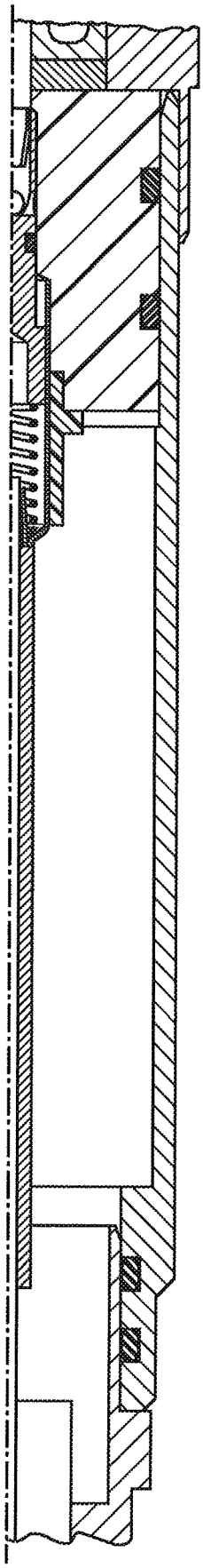
FIGS. 7A and 7B are partial view of the assembly according to an example embodiment.
Figure 7B:
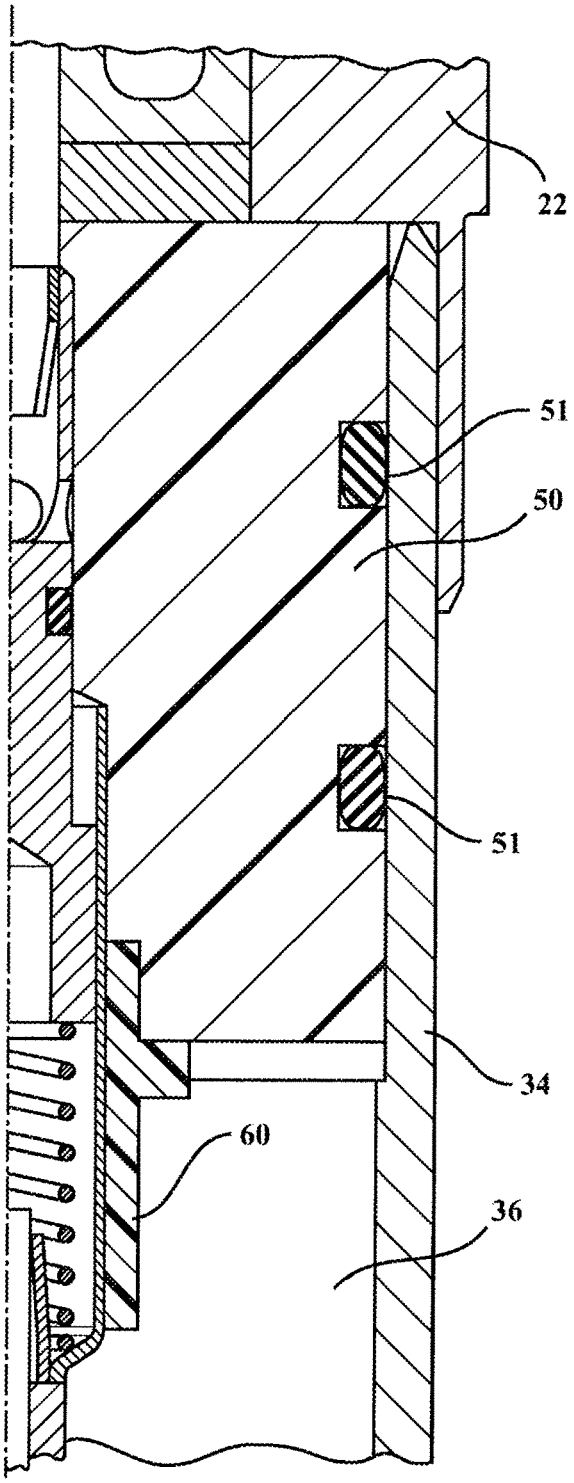
Figure 8C:
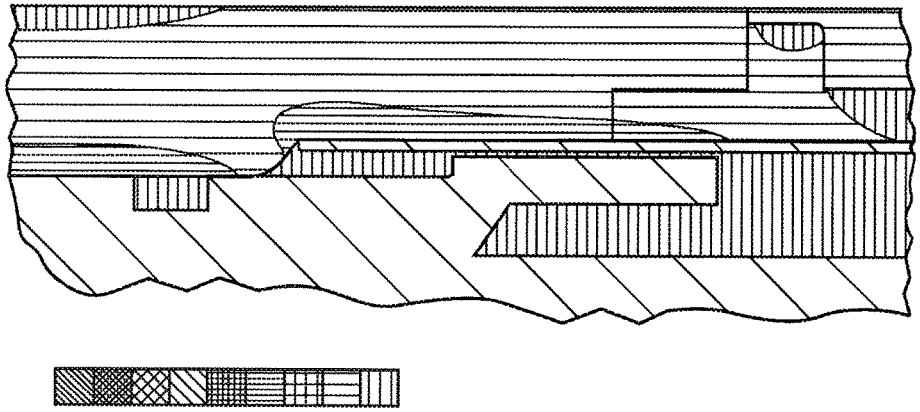
FIGS. 8B and 8C are FEA models showing the electrical field in portions of the assembly of FIG. 8A.
Figure 8B:
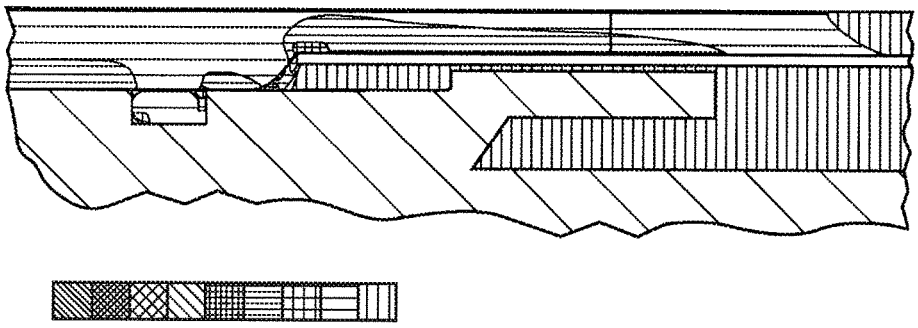
Figure 8A:
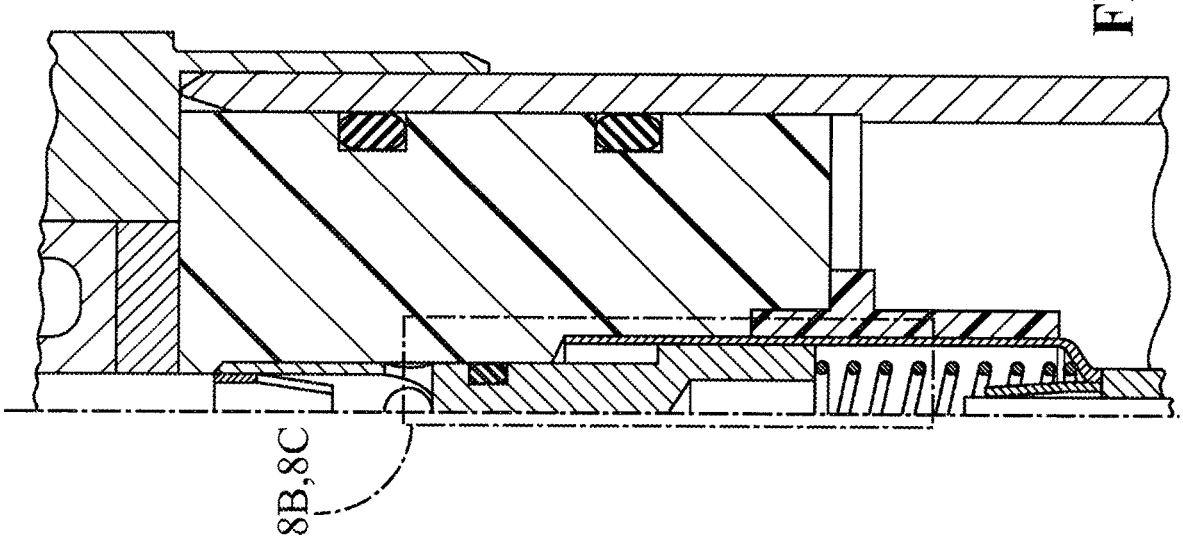
FIG. 8A is a partial view of the assembly according to an example embodiment.

The valve assembly 38 and a vacuum and pressurizing fixture assembly 64 are used to provide the insulating medium in the sealed pressure chamber 36. The example embodiment is shown in FIGS. 3 and 4. In its closed position, the O-ring 51 located around the valve stem 48 seals pressure chamber 36 formed in the tube 34. Alternatively, the valve stem 48 and/or another sealing device seals off the pressure chamber 36. The valve stem 48 and O-ring could also together seal the pressure chamber 36. During the vacuuming or pressurizing process, the valve assembly 38 is set to its open position, as shown FIGS. 3B and 4B, by pushing the valve stem 48 down against the spring 52 to a defined position which exposes at least one opening, for example the cross drilled holes 66 and axial hole 67 in the valve stem 48, to a cavity in a seat region 68. This cavity connects the pressure chamber 36 in the tube 34 below (to be vacuumed or pressurized) to an opening 70 on the top face of the valve housing 50. Once the insulating medium is provided and the pressure chamber 36 is pressurized, the differential force of the spring 52 along with the pressure in the sealed pressure chamber 36 forces the spring 52 upward and closes the valve assembly 38 shut. The valve assembly 38 in the closed position is shown in FIGS. 3A and 4A. The valve stem 38 is coupled to the coil assembly 22. In the example embodiment, the upper connector 62 on the top of the valve stem 48 is attached to the coil 30 via a pin 72 and acts as another central conductive element. The central conductor 32 is allowed to have floating contact in the bore of the insulator 40 of the corona igniter 28, providing for movement of the valve stem 48, thermal expansion, and electrical continuity.

As shown in FIGS. 4A and 4B, the combined vacuum and pressurizing assembly fixture 64 of the example embodiment is made up of an aluminum manifold 74, a steel push screw 76, and brass fixture stem 78. The vacuum and pressurizing assembly fixture 64 is screwed on to a coil receptacle nut 80 for operation. The push screw 76 is attached to the brass fixture stem 78 via a snap ring arrangement 82. When tightened to a stop, the push screw 76 pushes the brass fixture stem 78 to an open position, as shown in FIG. 4B. This in turn pushes the valve stem 48 in the open position, as shown in FIG. 3B. When the vacuum and pressurizing assembly fixture 64 is in the open position, all ports are open and the vacuum and pressurizing operation is carried out. In the open position, a pressurized gas inlet 84 is located along a first valve connector 86, and a vacuum outlet 88 is located along a second valve connector 86. Once the vacuum and pressurizing operation is done, the push screw 76 is brought to its original position and all ports are now in the closed sealed position, as shown in FIG. 4A.

The design described above can provide numerous advantages, including a very low loss, low dielectric constant fluid insulating medium in the extension 26 used to transfer of energy from the coil 30 to the corona igniter 28. The unique valve assembly 38 which is incorporated in the central conducting element of the extension 26 facilities compact packaging of the corona igniter 28 with the coil 30, which in the example embodiment is detachable.

The valve assembly 38 can also improve electrical fields and mitigate problems arising by attaching an external fill valve. The single vacuum and pressurizing assembly fixture 64 is designed to evacuate contents of the extension 26 and then fill the extension 26 with pressurized gas, such as nitrogen, through the valve assembly 38 (two-way application). More specifically, the advantages include reduced electric field in the valve assembly 38 and components surrounding the valve assembly 38. The valve assembly 38 is able to operate without moving the central conductor 32 where it passes out of the valve assembly 38, such that the central conductor 32 and center electrode 42 can be covered with insulating medium from top to bottom and occurrence of corona from the surfaces of the central conductor 32 and the central electrode 42 is reduced.

As indicated above, the improved design provides for reduced electrical fields in the valve assembly 52 and immediately surrounding the valve assembly 52. In addition, the valve assembly 52 can operate without moving the central conductor 32 where passes out of the value assembly 52. Thus, it is possible to surround the entire central conductor 32 in the tube 34 with the insulating medium and reduce the occurrence of corona discharge from the surface of the central conductor 32.

In comparative designs, a significant amount of energy transferred from the coil 30 to the corona igniter 28 is lost through the insulating medium and the extension 26 used to connect the coil 30 and the corona igniter 28. This can occur due to capacitive and dissipative losses, and possible loss due to formation of corona in the extension 26. Highly pressurized gas or fluid, such as greater than 30 bar, preferably having a low dielectric constant and loss factor, can suppress formation of corona or discharges from the central conductor 32 to ground. Thus, the pressurized gas or fluid can be used as the insulating medium in the extension 26. One example of such a gas is dry nitrogen gas at a pressure of greater than 30 bar, which is known to have a very low dielectric constant (such as ~1 or near 1). It is not trivial to pressurize and hold pressure in the extension 26 over the lifetime of the coil 30, extension 26, and corona igniter 28. By incorporating the pressurizing valve assembly 38 in to the central conductor 32 in the extension 26, the sealing surfaces are reduced and overall packaging of the corona igniter 28 is made compact which helps in better sealing of the components. The dual purpose of the valve assembly 38 as another centralized conductor lends to electrical field improvements when compared to attaching an external fill valve. As designed, the insulating medium, such as the pressurized gas, can fill the minutest of the crevices in the extension 26 and provides optimal insulation. The assembly can be made impermeable by using a combination of O-rings 51, sealant, and a rubber puck 90. In the example embodiment, the O-rings 50 are formed of a silicon-based material. The extension 26 is designed in such a way that the coil 30 is attached after the extension 26 is pressurized. The coil 30 is also detachable from the valve assembly 38 without de-pressurizing the extension 26. This feature enables improved maintenance capabilities of the igniter 28, such as removal, cleaning and replacement of the coil 30 without changing other components, and improved installation through the coil 30.

FIGS. 5A-9B include example embodiments of the valve assembly 38 and FEA models showing the effects of the reduced electrical field provided by the valve assembly 38 design. It is noted that the metal components of FIGS. 5A-9B, which are not conductors, are not modeled in the FEA results.

The designs included in FIGS. 7A-9B are preferred over the design of FIGS. 5A-6C because the design of FIGS. 5A-6C typically have movement of the central conductor 32 and higher electrical field throughout the valve assembly 38.

In the design of FIGS. 5A-6C, the valve stems 48 move ups and down when the valve assembly 38 operates. Hence, the central conductor 32 and the sleeve 56 also move up and down, and the sleeve 56 cannot completely cover the central conductor 32 as it approaches and goes into the firing end assembly 24. This can lead to flashover at the lower joint between the central conductor 32 and the firing end assembly 24. Also, the design of FIGS. 5A-6C typically has a higher electrical field than the designs of FIG. 7A-9B because of the clearances in the valve assembly 38, and the high electric field typically appears in these small clearances or gaps. Due to the electrical field level, the O-rings 51 typically have a reduced life and higher parasitic loss, compared to the O-rings 51 of FIGS. 7A-9B.

In the designs of FIGS. 7A-8C, movement of the central conductor 32 is avoided, and the electric field is reduced throughout the valve assembly 38. In these embodiments, the valve stem 48 moves up and down inside of the stationary valve housing 50. Thus, the central conductor 32 remains completely covered by the sleeve 56 and electric field throughout the valve assembly 38 is reduced, including everywhere inside the valve housing 50. It has been found that the electric field in the valve assembly 38 of FIGS. 7A-8C is actually zero in the valve housing 50. An electrical field does remain above the valve housing 50. It is noted that in the design of FIGS. 7A-8C, the plastic valve housing 50 can include a conductive coating along the bore of the plastic valve housing 50. A FEA analysis of this design is shown in FIG. 8B. In this case, the electric field is reduced, as shown by the FEA model. For example, the peak electric field can be approximately 3 times less when the conductive coating is applied, as in the design in FIG. 8B, compared to the design in FIG. 8A.

Figure 9B:
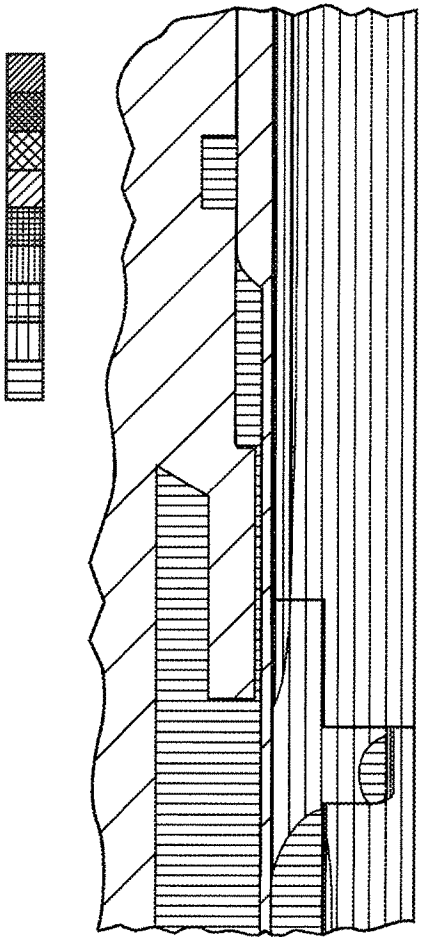
FIG. 9B is a FEA model showing the electrical field in portions of the assembly of FIG. 9A.
Figure 9A:
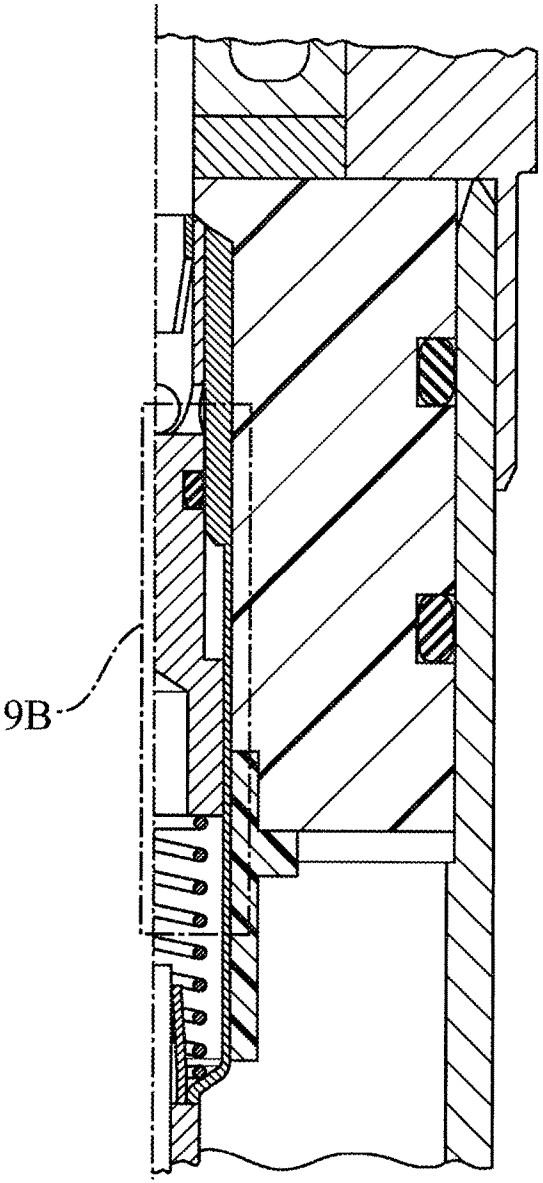
FIG. 9A is a partial view of the assembly according to an example embodiment.

In the design of FIGS. 9A and 9B, the conductive valve housing 50 completely covers the valve mechanism. The valve housing 50 can be one or more pieces. In the embodiment of FIGS. 9A and 9B, the valve housing 50 includes the inner portion 50*a*, in this case a plastic valve body, which completely covers the valve mechanism and is sealed to the outer portion 50*b* of the valve housing 50. For example, the inner and outer portions 50*a*, 50*b* of the valve housing 50 can be co-molded. In the design of FIGS. 9A and 9B, the electric field is reduced everywhere inside the valve housing 50, compared to other designs The FEA model shows the electric field is actually zero inside the valve housing 50 of FIGS. 9A and 9B. In addition, the peak electric field drops throughout the design of FIGS. 9A and 9B. It was found the peak electric field is about three times less than a similar design without the elongated plastic valve body 50*a*, similar to the embodiment of FIGS. 8A-8C with the conductive coating along the bore.

The design described above can be translated to work over various sizes of extension 26 length and corona igniter 28 sizes without significant modifications to the assembly. As discussed above, either a rigid or flexible air tight tube 34 could be used for the extension 26. The single vacuum and pressurizing assembly fixture 64 facilitates pulling a vacuum in the extension 26 and pressurizing the extension 26 by connecting to the valve assembly 38 in the same location where the coil 30 will be attached to the extension 26. This helps reduce assembly fixturing and components and expedites the assembly process.

The design described above includes a combination of metallic and plastic or other non metallic components. The valve assembly 38 is incorporated in to part of the central conductive element and is spring loaded. It is also noted that the valve assembly 38 can be used with the extension 26 when the extension 26 is flexible, the fluid medium is used as insulation, and the extension 26 can be of any overall length without modifications to the connecting features or the valve assembly 38. The coil 30 is detachable without depressurizing the assembly, and evacuation of the sealed pressure chamber 36 of the tube 34 and pressurizing of the tube 34 are carried out with the same vacuum and pressurizing assembly fixture 64. The valve assembly 38 is also scalable to different sized corona igniters 28.

It is noted that the extension 26, the valve assembly 38, and the combined vacuum and pressurizing assembly fixture 64 described herein are only example embodiments, and modifications of the example extension 26, the valve assembly 38, and the vacuum and pressurizing assembly fixture 64 described herein can be made.

Another aspect of the invention provides a method of manufacturing the corona igniter assembly 20. The method includes connecting the metal shell 46 of the firing end assembly 24 to the tube 34 of the extension 26, disposing the valve assembly 38 in the tube 34 of the extension 26, and connecting the valve assembly 38 to the central conductor 32. The method further includes connecting the valve assembly 38 to the ignition coil assembly 22 after filling the sealed pressure chamber 36 of the tube 34 with the insulating medium.

Yet another aspect of the invention provides a method for providing the insulating medium around the central conductor 32 of the corona igniter assembly 20. The extension 26 contains the sealed pressure chamber 36 which surrounds the central conductor 32. The valve assembly 38 is connected to the central conductor 32 and the extension 26. The method includes evacuating contents of the sealed pressure chamber 36, and then filling the sealed pressure chamber 36 with the insulating medium using the vacuum and pressurizing fixture 64 and the valve assembly 38. After filling the sealed pressure chamber 36, the vacuum and pressurizing fixture 64 and the valve assembly 38 is disconnected from the valve assembly 38, and the ignition coil assembly 22 is connected to the valve assembly 38.

Obviously, many modifications and variations of the present invention are possible in light of the above teachings and may be practiced otherwise than as specifically described while within the scope of the invention. It is contemplated that all features of all claims and of all embodiments can be combined with each other, so long as such combinations would not contradict one another.

What is claimed is:

1. A method of manufacturing an igniter assembly, comprising the steps of:

coupling a central conductor to a firing end assembly including an igniter, coupling the firing end assembly to an extension containing a pressure chamber, disposing a valve assembly in the pressure chamber of the extension, the valve assembly including a valve stem, and the valve stem and/or a sealing device located around the valve stem sealing the pressure chamber when the valve stem is biased away from the firing end assembly by a spring, evacuating contents of the pressure chamber by pressing the valve stem toward the spring and allowing contents of the pressure chamber to travel past the valve stem and out of the pressure chamber, filling the pressure chamber with an insulating medium by pressing the valve stem toward the spring and allowing the insulating medium to travel past the valve stem and into the pressure chamber after evacuating the contents out of the pressure chamber, biasing the valve stem away from the firing end assembly with the spring so that the valve stem maintains a seal of the pressure chamber containing the insulating medium, and coupling an ignition coil assembly including a coil to the central conductor.

2. A method according to claim 1, wherein the igniter is a corona igniter.

3. A method according to claim 1, wherein the central conductor is not movable in an axial direction.

* * * * *